United States Patent [19]

Fischer et al.

[11] 4,431,908

[45] Feb. 14, 1984

[54] ELECTRIC HEATING APPARATUS

[75] Inventors: Karl Fischer, Am Gansberg 23, D-7519 Oberderdingen, Fed. Rep. of Germany; Gerhard Goessler, Oberderdingen, Fed. Rep. of Germany

[73] Assignee: Karl Fischer, Fed. Rep. of Germany

[21] Appl. No.: 320,499

[22] Filed: Nov. 12, 1981

Related U.S. Application Data

[63] Continuation-in-part of Ser. No. 128,052, Mar. 7, 1980, abandoned.

[30] Foreign Application Priority Data

Mar. 9, 1979 [DE] Fed. Rep. of Germany ..... 2909238

[51] Int. Cl.[3] ..... H05B 3/68

[52] U.S. Cl. ..... 219/459; 219/432; 219/449; 219/457; 219/460; 219/462; 219/464; 219/467; 29/743; 228/221

[58] Field of Search ..... 219/430, 432, 433, 435, 219/438, 439, 443, 445, 446, 449, 450, 452, 454, 455–467, 78.11; 29/611, 615, 743; 228/221, 228; 338/238, 242

[56] References Cited

U.S. PATENT DOCUMENTS

| | | | |
|---|---|---|---|
| 1,257,106 | 2/1918 | Parkhurst | 219/457 |
| 1,659,774 | 2/1928 | Hicks | 219/459 |
| 2,196,484 | 4/1940 | Wentworth | 219/462 |
| 2,547,402 | 4/1951 | Lucas et al. | 219/459 |
| 2,664,492 | 12/1962 | Fischer | 219/462 X |
| 3,073,268 | 1/1963 | Cole | 219/78.11 X |
| 3,130,288 | 4/1964 | Monaco et al. | 219/439 X |
| 3,686,477 | 8/1972 | Dills et al. | 219/462 |
| 3,909,591 | 9/1975 | Ulam | 219/438 |
| 3,909,592 | 9/1975 | Eide | 219/462 |

FOREIGN PATENT DOCUMENTS

| | | | |
|---|---|---|---|
| 990334 | 6/1976 | Canada | 219/464 |
| 2351249 | 4/1975 | Fed. Rep. of Germany | 219/464 |
| 543223 | 8/1922 | France | 219/459 |
| 908348 | 4/1946 | France | 219/454 |
| 477751 | 1/1938 | United Kingdom | 219/457 |

*Primary Examiner*—Volodymyr Y. Mayewsky
*Attorney, Agent, or Firm*—Steele, Gould & Fried

[57] ABSTRACT

An electric heating apparatus for heating foods and liquids in a cooking vessel, comprising: a metal upper part, having an upper cooking surface and a lower surface; a metal lower part covering the bottom of the heating apparatus, a sealable space being formed between the upper part and the lower part; and, at least one tubular heating device with a metal covering arranged in the space and having a large flat contact surface for thermally conductively engaging the lower surface of the upper metal part, the space having at least a partial vacuum formed therein, the at least partial vacuum reducing convective heat loss and imparting a concave distortion to the upper metal part which counteracts a convex distortion of the upper metal part due to expansion upon heating, thereby holding the upper metal part substantially flat during heating and maximizing surface contact between the cooking surface and a cooking vessel resting thereon, whereby heat is transferred from the cooking surface to the cooking vessel with maximum efficiency.

The apparatus may also be constructed as a receptacle for directly heating foods or liquids.

13 Claims, 9 Drawing Figures

FIG. 1
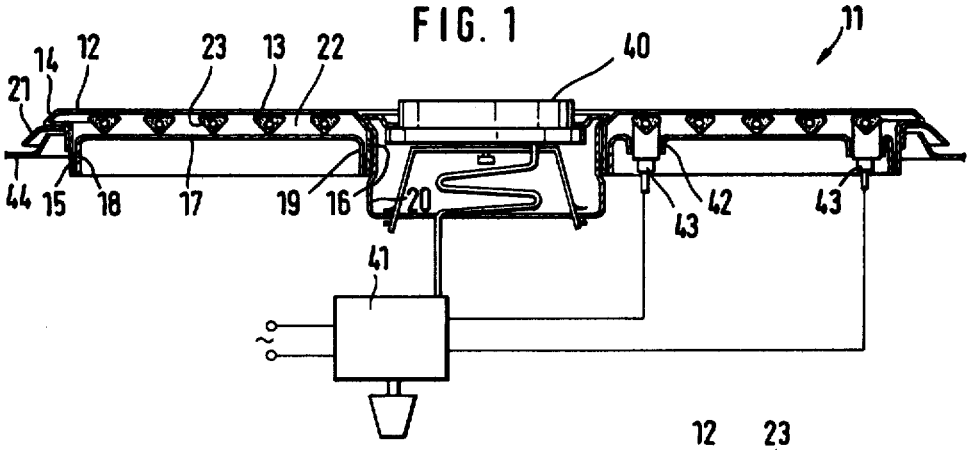
FIG. 2
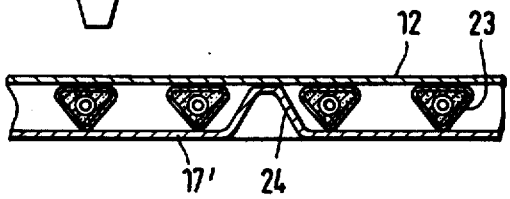
FIG. 3
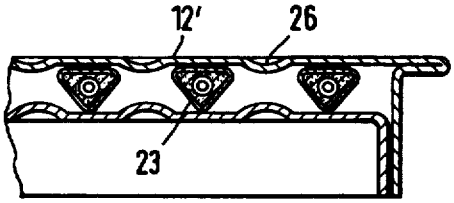
FIG. 4
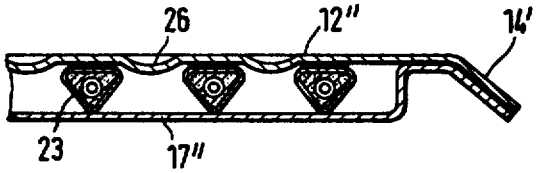
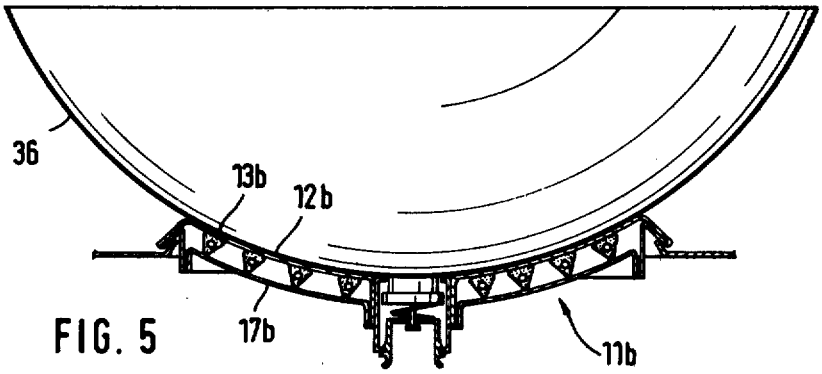
FIG. 5

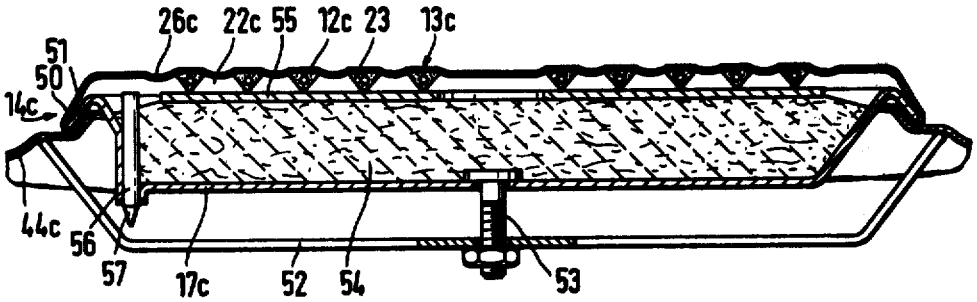
FIG. 7
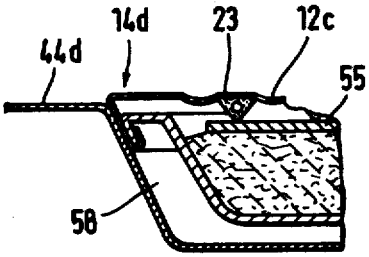
FIG. 8
FIG. 9
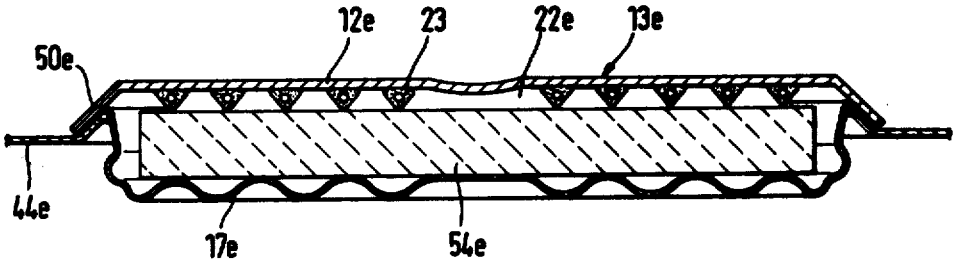

ELECTRIC HEATING APPARATUS

CROSS-REFERENCE TO RELATED APPLICATIONS

This application is a continuation-in-part of copending application Ser. No. 128,052, filed Mar. 7, 1980, now abandoned.

BACKGROUND OF THE INVENTION

The invention relates to an electric heating apparatus for heating foods or liquids. Normally, hot plates are used for this purpose and the cooking vessels are placed on the heating surface thereof.

The hot plates which are conventionally used in Europe and of which many millions have proved to be completely satisfactory are described for example in U.S. Pat. No. 4,122,330 and comprise a casting with coiled filaments housed in grooves in an embedding medium on the bottom thereof. While retaining the advantages of such hot plates, attempts are being made to improve them with a view to a lower thermal capacity and lower weight or material consumption. Although in the continuous state, the efficiency of the known hot plate is good, further energy could be saved by a lower thermal capacity in the case of short cooking processes (pre-cooking).

In addition, cooking elements are known comprising spiral tubular heating devices having a triangular cross-section and with an enlarged upper contact surface on which the cooking vessels are placed. Such hot plates are for example known in British Pat. No. 767,887 and U.S. Application Ser. No. 961,837, applied for on Nov. 17, 1978, inventor Gerhard Gössler. They have a very good efficiency, particularly for pre-cooking processes, due to their low thermal capacity. However, it is often considered disadvantageous that the heating devices are open and difficult to clean. Furthermore, in the construction according to British Pat. No. 767,887 the hot plate can be penetrated by overflowing food being cooked, which is very disadvantageous.

U.S. Pat. No. 2,299,596 describes a construction in which trapezoidal heating strips are connected via also trapezoidal intermediate members to a substantially planar plate. However, this plate is difficult to manufacture and has not proved successful under practical conditions.

Furthermore, U.S. Pat. Nos. 3,191,003, 3,632,983 and 3,789,189 disclose so-called glass ceramic cookers in which the cooking surface comprises a glass ceramic plate and which are heated from below by contact heating through triangular spirally wound tubular heating devices. Although these glass ceramic plates have the advantage of a closed upper cooking surface, which can optionally extend over several cooking positions, they have the disadvantage that the glass ceramic plate is a poor heat conductor and consequently the heat transfer from the bottom to the top and also the heat distribution are poor. The heating elements must be brought to very high temperatures in order to transfer sufficient energy and difficulties are encountered in the precise temperature regulation.

In order to bring about a better heat distribution, U.S. Pat. Nos. 3,674,983 and 3,686,477 disclose a glass ceramic heating system construction in which a sheet aluminium heat distribution plate is located between the glass ceramic plate and the heating elements and the tubular heating devices are soldered to the said aluminium plate. However, this construction must be very critical in operation due to the low melting temperature of aluminium and the high heating conductor temperatures necessary and does not improve the essential problems of the glass ceramic plate.

Finally, DOS No. 2,021,177 and U.S. Pat. No. 3,826,898 disclose attempts to create electric hot plates having an upper plate made from a composite material, for example copper between two surface layers of stainless steel and which are heated from below by tubular heating devices soldered thereto. Although the composite plate ensures a good heat distribution, it does not have a very low thermal capacity. Furthermore, difficulties are encountered in soldering the tubular heating devices on a mass production basis. This soldering is not carried out and thermal contact is poor.

Furthermore, German Utility Model 7,811,510 discloses a heating element in which the tubular heating device is firmly surrounded by a covering plate, but a great deal of heat is dissipated and lost.

SUMMARY OF THE INVENTION

In view of this prior art, the object of the present invention is to provide an electric heating element which is easy to manufacture and even after prolonged use still ensures a good passage of heat from the heating element to the heated food.

According to the invention, this object is accomplished by an electric heating element having an upper part made from metal whose top forms a heating surface, a lower metallic covering part, a space formed between the upper part and the covering part, at least one tubular heating device with a metal covering located in the said space which has a flat large contact surface to the bottom of the upper part and which engages in a thermally conducting manner with the bottom of the upper part, while using a vacuum.

The vacuum is used for engaging the tubular heating device to the bottom of the upper part, which has no grooves and is substantially smooth. In one construction, soldering is performed between the tubular heating device and the upper part under vacuum, said vacuum ensuring on the one hand a good engagement and on the other a completely satisfactory soldering. The vacuum can then be maintained in the space, although this is not absolutely necessary.

According to another preferred embodiment in which the vacuum is maintained in operation, the atmospheric pressure acting on the evacuated space in conjunction with a resilient construction of the upper and lower parts ensures that the tubular heating device engages with a thermally conductive contact to the bottom of the upper part. It is also possible to provide insulation between the tubular heating device and the lower part. It is also advantageous to support the tubular heating device on an internal base plate, if the upper part is resilient. This ensures, despite a very resilient and adaptable upper part, the tubular heating device coil provided in most cases remains flat and planar.

The present invention provides an electric heating element permitting a good heat transfer from the tubular heating device to the food being cooked. Due to the relatively small weight of the upper and lower parts, which can be made from sheet metal, for example stainless sheet steel, the thermal capacity is very low, so that the efficiency both in continuous and intermediate operation is good. Besides the preferred use as a hot plate, the heating element according to the invention can also be constructed in such a way that the upper part forms a container wall, for example that of an electric water heater.

BRIEF DESCRIPTION OF THE DRAWINGS

The invention is described hereinafter relative to preferred non-limitative embodiments and the attached drawings, wherein:

FIG. 1 is a diagrammatic cross-section through a heating element in the form of a hot plate;

FIGS. 2 to 4 are details of embodiments;

FIG. 5 is a heating element for a cooking vessel with a curved bottom;

FIG. 7 is a section through a further preferred embodiment;

FIG. 8 is a detail of a variant of FIG. 7; and,

FIG. 9 is a further embodiment in cross-section.

DETAILED DESCRIPTION OF THE PREFERRED EMBODIMENTS

Figure 6:
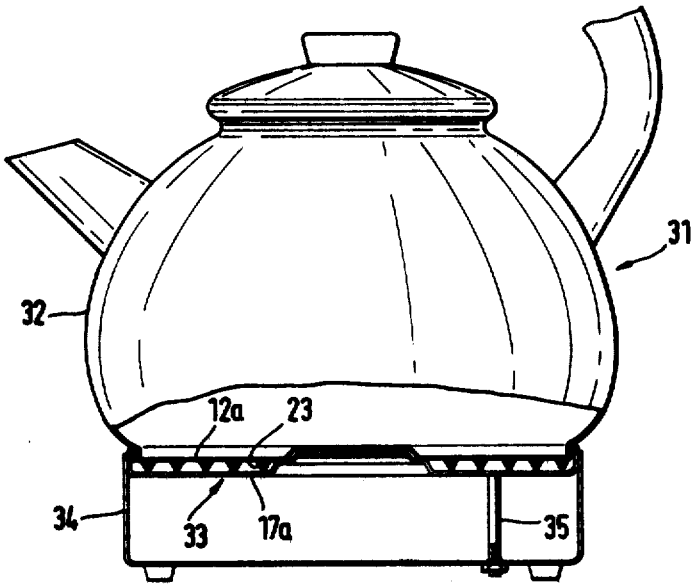
FIG. 6 is a cross-section through a water heater with a heating element.

The electric heating element 11 shown in FIG. 1 is made from stainless sheet steel (0.1 to 0.6 mm thick) and has an upper part 12 containing a planar, annular heating surface 13, and all-round, laterally shaped flange 14, a downwardly directed annular edge 15 and an inner annular edge 16.

The bottom of the annular heating area is covered by a lower part 17, which is also made from stamped sheet metal and which also has an outer and inner downwardly directed edges 18, 19. The unheated middle area contains a cylindrical sleeve 20 having an upper and a lower flange and a temperature sensor member, for example the movable sensor member 40 of an automatic temperature regulator 41.

Onto flange 14 bears a sheet metal ring 21 forming an overflow edge supported on a cooker plate or tray 44.

A space 22 in which are located spiral tubular heating devices 23 is formed between upper part 12 and lower part 17. The tubular heating devices have a metal covering and heating resistors located in an embedding medium. The covering is triangular, so that the upper, substantially planar triangular side of the tubular heating devices 23 engage from the inside on heating surface 12, while they only have a linear contact on the lower part in the vicinity of the angle of the triangle.

The tubular heating devices are sealingly passed through a downwrdly directed socket member 42 of the lower part.

The connection of the upper and lower parts and the tubular heating device thereto is effected by soldering in vacuum. For this purpose, a soldering foil is placed or a soldering powder is scattered between the sheet metal parts and the tubular heating devices and after evacuating the space 22 soldering is carried out by heating the unit. Heating can also take place inductively. As a result, a very stable hot plate is formed which does not tend to warp. A rigid sandwich structure is formed with the tubular heating devices also soldered to the lower part.

FIG. 2 shows an embodiment in which a stud-shaped, upwardly directed member 24 is provided in lower part 17' and this ensures the necessary spacing between the upper and lower parts during soldering. Supporting members 24 can be provided in the upper part or in the upper and lower parts.

In the embodiment of FIG. 1, the outer flange 14 has a lower substantially planar surface and a following chamfer passing to the cooking surface 13. However, in FIG. 3, the flange is formed by bending the heating surface sheet by 180°. This flange can either be placed directly on the cooking tray surface or there can be an intermediately positioned overflow edge.

In the embodiment of FIG. 3, inwardly directed impressions 26 are provided in both the upper and lower parts and are positioned in each case between the tubular heating devices and consequently normally form a spiral pattern on the top and bottom. These impressions ensure a reinforcement of the surfaces, but still permit radial elongations. It is particularly advantageous if these impressions are made during a straightening process following soldering.

The embodiment of FIG. 4 also has such impressions 26, but only in the vicinity of the upper part. Flange 14' is directed outwards and in an inclined downwards direction and comprises the soldered or welded together edges of upper and lower parts 12'', 17'', so that it forms the overflow edge.

FIG. 5 shows a heating element **11*b*, whose fundamental construction corresponds to that of FIG. 1. However, both the upper part 12*b* and the lower part 17*b* are spherical, so that the cooking surface 13*b* has a concave configuration. In the latter, it is possible to place a cooking vessel 36** with a curved bottom. The curved construction provides an additional reinforcement and here again a central sensor member is provided, while the central sensor opening ensures an additional hold between the upper and lower parts.

FIG. 6 shows a water heater 31 which has a vessel 32 with a cover and a socket member, together with a bottom 33 formed by the upper part **12*a* of the heating element received in a housing 34** in the form of a dish, which is open at the top and stands on feet.

Upper part **12*a* forms the vessel wall and/or bottom, while lower parts 17*a* is soldered thereto. In the connecting area, the covering portion and the heating surface are directed upwards and soldered to the wall of vessel 32. The tubular heating devices 23 are soldered under vacuum. The unit formed by the vessel and the heating element are fixed to the housing 34 by means of a bolt 35**.

FIG. 7 shows a particularly preferred embodiment of an electric heating element in which the upper part **12*c* is made from a very thin sheet of stainless steel with a thickness of approximately 0.2 to 0.3 mm. This sheet has planar areas forming the actual cooking surface 13*c* and from below are in flat contact with the spirally arranged tubular heating devices 23 having a triangular cross-section. Between the heating surface areas 13*c* are provided depressions 26*c***, which increase the resilience and flexibility of the thin upper part.

In the marginal area, the upper part is inclined downwards in dish-shaped manner and has a flange 50 around the also downwardly directed outer edge 51 of lower part **17*c***. In this area, the two parts are tightly soldered or welded together.

Though part **17*c* is made from a significantly thicker sheet material it forms a stable pan. By means of edge 14*c* it engages over an upwardly directed edge of the cooker plate 44*c* and is fixed by means of a bow-shaped member 52 and a central bolt 53 welded into lower part 17*c* with the cooker plate 44*c***.

The flat, dish-like lower part **17*c* contains an insulating layer 54**, made from a random heat-resistant, solid, fibrous or granular insulating material, preferably shaped in the form of a disk. Preference is given to the inorganic fibrous material known under the trade name Fiberfrax.

The insulating material 54 carries a base plate 55 made from a metal or rigid insulating material. The lower apex of the triangular tubular heating device 23 engages on the planar base plate 55.

A tubular suction connection 56 is tightly engaged in the marginal area of lower part 17*c* and it projects into the space 22*c* formed around the heating device. The space 22*c* between the upper and lower parts is evacuated via the suction connection 56, which is then squeezed at its lower end 57 and tightly soldered or welded, so that the vacuum can be maintained. As a result, the relatively thin, membrane-like upper part 12*c* is pressed inwardly by the atmospheric pressure and presses onto the tubular heating devices 23, which are in turn pressed onto plate 55, which bears on lower part 17*c* via the insulating layer 54. If a very soft, for example granular insulating layer is used, it would also be possible to connect the base plate 55 via supports to the lower part 17*c*, but the minimum of thermal bridges to the lower part should be formed.

In the case of this heating element, the lower part 17*c* ensures an adequate supporting or carrying action, the insulation with respect to the bottom is excellent and the contact between the tubular heating device and the membrane-like upper part is always maintained as a result of the action of atmospheric pressure. The base plate ensures a planar surface, although the upper part is itself flexible. The vacuum contributes to the good insulation with respect to the bottom. In particular, the mass to be heated during initial heating is very small and essentially only comprises the tubular heating devices and the very thin upper part. Thus, the hot plate has a very low thermal capacity and excellent insulation in the downwards direction and good efficiency levels are obtained both in continuous and intermittent operation. However, the cooking surface is closed, easy to clean and food being cooked cannot run through.

FIG. 8 shows a construction in which the heating element is the same as that of FIG. 7, except for the edge configuration. It is arranged in a cooking tray comprising a cooker plate 44*d* and a dish-shaped tray 58 shaped onto it and which contains the heating element. Due to the walls of tray 58, which widen in an upwardly sloping manner, the edge 14*d* of the heating element, with an otherwise identical connection of upper and lower parts is constructed so as to widen conically upwards, unlike in FIG. 7, so that the heating element fits into the tray 58.

FIG. 9 shows a construction having an upper part 12*e* made from a somewhat thicker metal sheet with a thickness of 1 to 2.5 mm and whose top forms a planar cooking surface 13*e*. The edges 50*e* are conically downwardly tapered and embrace an upwardly directed edge of a cooker plate 44*e*. Edge 50*e* is tightly connected to a lower part 17*e*, which is made in the form of a thin corrugated, flexible metal membrane of very thin sheet metal (0.2 to 0.3 mm thick). An insulating layer 54*e* is located in this dish-shaped metal bellows. In this case, the insulating layer is made from a constructionally fixed insulating material and the tubular heating device coil 23 engages by its bottom surface directly on the insulating layer 54*e*. The space 22*e* between the upper and lower parts is evacuated, so that the resilient lower part 17*e* under the external atmospheric pressure presses the insulating layer 54*e* against the tubular heating device and the latter is made to engage flat with the bottom of upper part 12*e*. The term vacuum is understood to mean a reduced atmospheric pressure. The vaccum need not be very high, because the corresponding forces are generally sufficient with even a limited vacuum.

Heated cooking surfaces normally tend to curve upwardly, imparting a certain convex distortion to the cooking surface. Even if such a distortion is quite small, it is nevertheless sufficient to prevent a large surface contact area to exist between the top of the cooking surface and the bottom of a cooking pot resting thereon. As a result, large inefficiencies in heat transmission are introduced into the system. Moreover, the pots and pans tend to rock on the cooking surface, becoming less stable and more prone to being accidentally tipped over. It has been discovered that the vacuum, or at least partial vaccum which is utilized to ensure good surface contact and efficient thermal transmission from the tops of the tubular heating bodies to the bottom surface of the upper plate also tends to impart a certain concave distortion to the cooking surface, which counteracts the convex distortion due to thermal expansion upon heating.

The vacuum compensation is most easily illustrated in connection with the embodiments of FIGS. 7 and 9. Electric cooking plates are frequently provided in different sizes and different heating capacities in the same stove or range top. Accordingly, the vacuum compensation will be illustrated with respect to both a small and large diameter version of the FIG. 7 embodiment as well as a single version of the FIG. 9 embodiment. The specific information to follow is illustrative only, and should not be deemed as limiting the scope of the claims presented herein.

In the smaller version of the FIG. 7 embodiment the upper plate 12*c* has an outer diameter of 160 mms. and the heating zone has a diameter of 145 mms. The thickness of upper plate 12*c* is in the range of 0.2 mms. to 0.5 mms., 0.3 mms. being the preferred thickness. The thickness of the lower plate 17*c*, as well as the thickness of plate 55, is in the range of 0.8 mms. to 1.5 mms., 1.0 mms. being preferred. The diameter of the tubular heating devices 23 (although they are in fact illustrated as having a triangular cross-section) is in the range of 3.5 mms. to 4.5 mms., 3.85 mms. being preferred. The effective length of the tubular heating devices 23 is in the range of 950 mms. to 1,200 mms., 1,100 mms. being preferred. The insulation 54 is a ceramic fibre pressed into a relatively rigid form, having a thickness in the range of 5 mms. to 10 mms., 8 mms. being preferred. The insulation may also be a mixture of pyrogenous silica. The rated input of the cooking plate is 1,200 watts. The distortion of the cooking surface (upper plate 12*c*) without the application of a vacuum was more than 10 mms. When a vacuum of 0.5 bar absolute pressure (one-half atmosphere), or less (successful results were also attained at the high vacuum level of 0.05 bar absolute pressure), was applied to the interior of the cooking plate, the distortion of the cooking surface was reduced to less than 1 mm.

In the large version of the FIG. 7 embodiment the outer diameter of upper plate 12*c* is 200 mms. and the diameter of the heated zone is 160 mms. The thickness of upper plate 12*c* is in the range of 0.2 mms. to 0.5 mm., 0.35 mms. being preferred. The thickness of lower plate 17*c*, as well as plate 55, is in the range of 0.8 mms. to 1.5 mms., 1.2 mms. being preferred. The diameter of the tubular heating devices is in the same range as that described in connection with the smaller version. The effective length of the tubular heating devices is in the range of 1,300 mms. to 1,700 mms., 1,500 mms. being preferred. The insulation layer 54 is the same as that described in connection with the smaller version. The rated input is 1,600 watts. Distortion of the cooking surface without the application of a vacuum was also more than 10 mms. Upon application of a vacuum of 0.5 (and 0.05) bar absolute pressure the distortion was reduced to less than 1 mm.

In the FIG. 9 embodiment the outer diameter of upper plate 12*e* is 160 mms., and the diameter of the heated zone is 145 mms. The thickness of upper plate 12*e* is in the range of 1.5 mms. to 3.5 mms., 3.0 mms. being preferred. The thickness of lower plate 17*e* is in the range of 0.2 mms. to 0.5 mms., 0.3 mms. being preferred. The diameter of the tubular heating devices is the same as that described in connection with the FIG. 7 embodiments. The effective length of the tubular heating devices is in the range of 950 mms. to 1,200 mms., 1,100 mms. being preferred. The insulation 54*e* is a ceramic fibre pressed into a relatively rigid form, having a thickness in the range of 5 mms. to 10 mms., 8 mms. being preferred. The rated input is 1,300 watts. Although in this embodiment distortion without application of a vacuum was less than 1 mm., nevertheless, there was no substantial contact between the bottom surface of upper plate 12*e* and the upper surface of the tubular heating devices 23. Upon application of a vacuum of 0.5 (and 0.05) bar absolute pressure the distortion remained less than 1 mm., but there was virtually complete contact between the lower surface of upper plate 12*e* and the upper surface of the tubular heating devices 23.

Cooking plates according to this invention can be easily manufactured so as to have a very low thermal capacity, with a maximum heat transfer to the cooking surface and a minimum of downwardly directed thermal loss. Thermal or heating capacity can be tested by measuring the power consumed in heating a certain amount of food to a certain temperature. A typical test is the amount of power needed to heat one liter of water from 20° C. to 100° C. (68° F. to 212° F.). It has been found that evacuated cooking plates made in accordance with this invention require up to 20% less power than other kinds of cooking plates with closed upper surfaces. Accordingly, cooking plates made in accordance with this invention can be rated for smaller power inputs without detracting from the effectiveness of the cooking plate or increasing necessary cooking times. In particular, the rated input of the smaller version of the FIG. 7 embodiment is 1,200 watts instead of 1,500 watts; the rated input of the larger version of the FIG. 7 embodiment is 1,600 watts instead of 2,00 watts; and, the rated input of the FIG. 9 embodiment is 1,300 watts instead of 1,600 watts. This represents a very substantial savings of energy, particularly over the lifetime of the cooking plate.

Evacuated cooking plates according to this invention not only provide significantly improved efficiency of operation, but also provide considerable rigidity of construction, and are therefore stronger and more durable. They are also better able to support the loads of cooking pots and their contents without being inordinately reinforced. Moreover, the vacuum between the upper and the lower parts ensures that no corrosion or oxidation can occur in the space, and also reduces thermal losses due to convection.

This invention may be embodied in other specific forms without departing from the spirit or essential attributes thereof, and accordingly, reference should be made to the appended claims, rather than to the foregoing specification, as indicating the scope of the invention.

We claim:

1. An electric heating apparatus for heating foods and liquids in a cooking vessel, comprising:

a metal upper part having upper and lower surfaces, the upper surface forming a cooking surface for the cooking vessel;

a metal lower part covering the bottom of the heating apparatus, a sealable space being formed between the upper part and the lower part;

at least one tubular heating device with a metal covering arranged in the space and having a large flat contact surface for thermally conductively engaging the lower surface of the upper part, the space having at least a partial vacuum formed therein; and, one of the upper and lower parts being constructed as a resilient, relatively thin-walled membrane with respect to the other of the upper and lower parts, and having elongation zones, and the other of the upper and lower parts being relatively thick, with respect to the part constituting the thin-walled membrane, and forming the only principal load bearing member of the apparatus and for cooking vessels placed on the apparatus, the at least partial vacuum and atmospheric pressure together imparting a concave distortion to the upper metal part which counteracts a convex distortion of the upper metal part due to expansion upon heating, and at the same time, imparting a concave distortion to the flexible membrane, which as a result of the elongation zones, continuously presses the at least one heating device and the lower surface of the upper metal part into thermal engagement with one another, notwithstanding the concave and convex distortions to which the upper metal part is subjected, the upper metal part being thereby held substantially flat during heating, maximizing the surface contact between the cooking surface and a cooking vessel resting thereon;

whereby a maximum efficiency of operation is achieved by: a low thermal inertia of the heating apparatus engendered by the absence of members capable of storing heat and the absence of structure capable of conducting heat away from the cooking surface; the continuous thermal engagement of the at least one heating device with the lower surface of the upper metal part irrespective of distortion; and, the substantial flatness of the cooking surface which maximizes surface contact and heat transfer between the cooking surface and the cooking vessel.

2. An apparatus according to claim 1, wherein the upper and lower metal parts are permanently sealed for maintining the at least partial vacuum in the space.

3. An apparatus according to claim 1, wherein the at least one heating device has a triangular cross-section, one flat side thereof engaging the lower surface of the upper metal part.

4. An apparatus according to claim 1, further comprising an external flange forming an edge for cooperating with a mounting cut-out in a cooker plate.

5. An apparatus according to claim 1, wherein the upper and lower metal parts each have downwardly directed edges which are sealably connected to one another.

6. An apparatus according to claim 1, further comprising an insulating layer disposed in the space between the at least one heating device and the lower metal part.

7. An apparatus according to claim 6, further comprising a base plate disposed between the insulating layer and the at least one tubular heating device.

8. An apparatus according to claim 1, further comprising a downwardly directed outer flange for receiving an upwardly directed overflow edge of a mounting cut-out in a cooker plate.

9. An apparatus according to claim 8, wherein the upper and lower metal parts are tightly connected by a bead in the area of the outer flange.

10. An apparatus according to claim 1, wherein at least one of the upper and lower metal parts comprises a spiral depression in the area between adjacent portions of the at least one heating device.

11. An apparatus according to claim 1, further comprising at least one support member projecting through the space.

12. An apparatus according to claim 1, wherein the lower metal part is provided with socket-shaped openings through which the at least one heating device passes out of the space, the openings being sealed.

13. An apparatus according to claim 1, wherein the apparatus is provided with a central opening formed by a downwardly directed edge of the upper metal part, the edge being sealably connected to the lower metal part.

* * * * *